US011746422B2

(12) United States Patent
Sonk et al.

(10) Patent No.: US 11,746,422 B2
(45) Date of Patent: Sep. 5, 2023

(54) METHOD OF APPLYING AN INTERMETALLIC ANTICORROSION COATING BY THERMAL DIFFUSION GALVANIZATION

(71) Applicant: MAJORPACK INCORPORATED, Houston, TX (US)

(72) Inventors: Aleksey Nikolaevich Sonk, Moscow (RU); Igor' Vladimirovich Petrov, pos.Kurkino (RU); Igor' Petrovich Yarema, Dolgoprudnyiy (RU)

(73) Assignee: MAJORPACK INCORPORATED, Houston, TX (US)

( * ) Notice: Subject to any disclaimer, the term of this patent is extended or adjusted under 35 U.S.C. 154(b) by 2 days.

(21) Appl. No.: 17/637,204

(22) PCT Filed: Oct. 16, 2020

(86) PCT No.: PCT/RU2020/000544
§ 371 (c)(1),
(2) Date: Feb. 22, 2022

(87) PCT Pub. No.: WO2021/034223
PCT Pub. Date: Feb. 25, 2021

(65) Prior Publication Data

US 2022/0290305 A1 Sep. 15, 2022

(30) Foreign Application Priority Data

Aug. 22, 2019 (RU) ..... RU2019126536

(51) Int. Cl.
*C23C 24/00* (2006.01)

(52) U.S. Cl.
CPC ..... *C23C 24/00* (2013.01)

(58) Field of Classification Search
None
See application file for complete search history.

(56) References Cited

FOREIGN PATENT DOCUMENTS

| | | | | |
|---|---|---|---|---|
| CN | 102168244 | A | | 8/2011 |
| RU | 2500833 | C1 | * | 12/2013 |
| RU | 2500833 | C1 | | 12/2013 |
| RU | 2559386 | C1 | | 8/2015 |
| UA | 72820 | C2 | | 4/2005 |

* cited by examiner

*Primary Examiner* — Alexander M Weddle
(74) *Attorney, Agent, or Firm* — Nadya Reingand

(57) ABSTRACT

Proposed is a method of applying a zinc coating to metallic articles by thermal diffusion galvanization. Articles to be treated and a two-component zinc mixture are loaded into a hermetically sealed container, the cavity of the container is filled with an inert gas, and heating is carried out. The first component of the mixture, in the form of a powder of acicular zinc having a size of 3-5 μm, is loaded directly into the container, and the second component, in the form of a powder of spherical zinc having a size of 20-25 μm, is loaded into a capsule having walls which disintegrate at a temperature of 400±20° C., which is placed in the container at the same time as the articles to be treated. A flux is loaded into the container, and an inert process gas and an activating agent for intensifying the adhesion process are supplied.

1 Claim, No Drawings

METHOD OF APPLYING AN INTERMETALLIC ANTICORROSION COATING BY THERMAL DIFFUSION GALVANIZATION

TECHNICAL FIELD OF THE INVENTION

The invention relates to the chemical-thermal treatment of metal articles, particularly to diffusion galvanization, and can be used in machine-building, instrument-making, aviation and other industries.

BACKGROUND OF THE INVENTION

There are currently various methods for diffusion galvanization.

Patent RU 2386723 discloses a method for diffusion galvanization, which includes preparing a surface of an article, loading articles into a working chamber together with powdered components containing powdered zinc, evacuating the working chamber and pumping an inert gas, heating the working chamber to a working temperature of 350-450° C., which ensures the formation of a film of a given thickness.

Patent RU 2180018 describes a method for manufacturing a powder mixture for thermal diffusion galvanization. The powder mixture consists of a zinc mixture containing fractions having an acicular shape and a spherical shape and a size of less than 63 μm.

Thermal diffusion galvanization is performed in the presence of zinc chloride (in the claimed invention—a flux), an inert process gas and an activating agent. In this case, the process temperature is 300-450° C.

US 20180016482 A1 and US 20090266454 A1 also disclose a galvanization process in which a destructible capsule is used, as in the claimed method.

Patent RU 2500833 describes an invention which relates to the chemical-thermal treatment of metal articles, in particular to diffusion galvanization. Articles to be treated are arranged in a container in a regular manner in accessories with supporting surfaces, which fix them and prevent their direct contact between each other and movement relative to each other when the container moves such that the minimum distance between the treated surfaces of the articles is 3-5 mm. During the galvanization process, the articles to be treated can perform movements relative to the supporting surfaces of the accessories in the container by not more than 5-10 mm. A saturating mixture contains zinc crystals having a purity of 0.97-0.99% and an acicular shape. The saturating mixture has a particle size distribution within the range of 3-7 urn, and its weight is 1-4% of the weight of the articles to be treated or 130-140% of the weight of the required coating on the surface of the articles to be treated.

SUMMARY OF THE INVENTION

The technical result of the invention is to increase the service life of an article by eliminating its corrosion and to increase the productivity of a furnace in which diffusion galvanization is performed, as well as to reduce zinc consumption per unit surface of the article to be treated.

The claimed technical result is achieved by performing a method for applying a zinc coating to metallic articles by thermal diffusion galvanization. The method comprises loading articles to be treated into a hermetically sealed container, loading a saturating zinc-containing mixture into the container, filling a cavity of the container with an inert gas, and heating. According to the solution to be patented, a two-component zinc mixture is loaded as the zinc-containing mixture. The first component of the mixture is in the form of a powder of acicular zinc having a size of 3-5 μm and is loaded directly into the container, while the second component of the mixture is in the form of a powder of spherical zinc having a size of 20-25 μm and is loaded into a capsule having walls which disintegrate at a temperature of 400±20° C. The capsule is placed in the container concurrently with the articles to be treated. The amount of the first component is 80% of the theoretical value of a weight required to cover the surface of the articles to be treated with an inner layer and 60% of the theoretical value of a weight required to cover the surface of the articles to be treated with an outer layer. After that, a flux is loaded into the container, and an inert process gas and an activating agent for intensifying an adhesion process are supplied. The galvanization process is performed in two steps: first, heating to a temperature of 350-380° C. to form the inner layer of zinc due to the adhesion of the acicular zinc to the surface of the article to be treated, and then after heating the capsule material to the disintegration temperature of 400±20° C. and releasing the powder of spherical zinc to form the outer layer of the coating.

DETAILED DESCRIPTION OF THE INVENTION

A method for applying a zinc coating to metallic articles by thermal diffusion galvanization is performed as follows:

- The articles to be treated are loaded into a hermitically sealed container on supporting surfaces which prevent their direct contact and provide a minimum distance between the articles within the range of 3-5 urn, while ensuring the possibility of their movement relative to the supporting surfaces by no more than 5-10 mm;
- At the same time, a two-component mixture is loaded into the same container, which has a first component as a powder of zinc having a purity of 0.97-0.99%, an acicular shape and a crystal size of 3-7 μm (preferably 3-5 μm) and a second component as a powder of zinc having a spherical shape with a size of 20-25 μm. The second component is loaded into a capsule having walls which disintegrate at a temperature of 400±20° C. In this case, the amount of the first component is 80% of the theoretical value of a weight required to cover the surface of the articles to be treated and 60% of the theoretical value of the weight required to cover the surface of the articles to be treated with an outer layer;
- Then, a flux is loaded into the container, and an inert process gas and an activating agent for intensifying an adhesion process are supplied.

The galvanization process is performed in two steps: first, heating to a temperature of 350-380° C. to form an inner layer of zinc due to the adhesion of the acicular zinc to the surface of the article to be treated, and then after heating the capsule material to the disintegration temperature of 400±20° C. and releasing the spherical zinc to form the outer layer of the coating.

Thus, the claimed invention is characterized in that the two-component mixture is used, in which only one of the components is placed into the capsule, and in that spherical zinc particles constituting the second component of the mixture are applied to the inner layer formed by acicular zinc particles.

What is claimed is:

1. A method for applying a zinc coating to metallic articles by thermal diffusion galvanization, comprising:

loading articles to be treated into a hermetically sealed container;

loading a saturating zinc-containing mixture into the container;

filling a cavity of the container with an inert gas; and heating;

wherein a two-component zinc mixture is loaded as the zinc-containing mixture;

wherein the two-component zinc mixture has a first component as a powder of acicular zinc having a size of 3-5 μm and loaded directly into the container, and a second component as a powder of spherical zinc having a size of 20-25 μm and loaded into a capsule having walls which disintegrate at a temperature of 400±20° C., the capsule being placed in the container concurrently with the articles to be treated;

wherein the first component is provided in an amount of 80% of a theoretical value of a weight required to cover a surface of the articles to be treated with an inner layer and 60% of a theoretical value of a weight required to cover the surface of the articles to be treated with an outer layer;

wherein a flux is loaded into the container, and an inert process gas and an activating agent for intensifying an adhesion process are supplied;

wherein the galvanization process is performed in two steps: first, heating to a temperature of 350-380° C. to form the inner layer of zinc due to an adhesion of the acicular zinc to the surface of the article to be treated, and then after heating a material of the capsule to the disintegration temperature of 400±20° C. and releasing the powder of spherical zinc to form the outer layer of the coating.

* * * * *